US005223846A

United States Patent [19]

Campbell

[11] Patent Number: 5,223,846

[45] Date of Patent: Jun. 29, 1993

[54] MULTIPLE-BEAM TRANSMISSION SYSTEM

[75] Inventor: Robert D. Campbell, Edinburgh, Scotland

[73] Assignee: GEC-Ferranti Defence Systems Limited, Stanmore, United Kingdom

[21] Appl. No.: 656,644

[22] Filed: Feb. 19, 1991

[30] Foreign Application Priority Data

Feb. 20, 1990 [GB] United Kingdom ..... 9003813

[51] Int. Cl.[5] ..... H01Q 3/22; H01Q 3/24; H01Q 3/26

[52] U.S. Cl. ..... 342/372

[58] Field of Search ..... 342/372, 408, 368

[56] References Cited

U.S. PATENT DOCUMENTS

| | | | |
|---|---|---|---|
| 4,257,050 | 3/1981 | Ploussios | 342/372 |
| 4,675,681 | 6/1987 | Kinsey | 342/372 |
| 4,849,763 | 7/1989 | Dufort | 342/372 |
| 4,860,752 | 8/1989 | Turner | 128/422 |
| 4,994,814 | 2/1991 | Aoki et al. | 342/372 |

FOREIGN PATENT DOCUMENTS

| | | |
|---|---|---|
| 0109786 | 5/1984 | European Pat. Off. . |
| 253465 | 1/1988 | European Pat. Off. . |
| 2130801 | 6/1984 | United Kingdom . |
| 2135520 | 8/1984 | United Kingdom . |

OTHER PUBLICATIONS

Certo et al., "A Programmable Pulse Generator for Piezoelectric Multielement Transducers", *Ultrasonics*, Jul., 1984, pp. 163–166.

Skolnik, Merrill I., "Simultaneous Multiple Beams From Array Antennas," pp. 310–316, *McGraw-Hill Book Company*, Introduction to Radar Systems, Second Edition.

*Primary Examiner*—Theodore M. Blum

*Attorney, Agent, or Firm*—Spencer, Frank & Schneider

[57] ABSTRACT

A multiple-beam energy transmission system for the simultaneous transmission of at least two beams of energy directed in different directions from a single multi-element transducer assembly includes a signal source arranged to generate a train of successive signal pulses. Signal modifying circuitry associated with each element is provided for modifying the phase of each successive signal pulse by applying to each successive signal pulse a complex aperture weighting function, different phase shifts being applied to successive signal pulses, the phase shifts applied for one beam being unrelated to those applied for another. Control circuitry controls operation of the signal modifying circuitry such that the complex aperture weighting function applied to each successive signal pulse from the signal source by the signal modifying circuitry results in the radiation of the required beams of energy from the multi-element transducer assembly.

8 Claims, 3 Drawing Sheets

MULTIPLE-BEAM TRANSMISSION SYSTEM

BACKGROUND OF THE INVENTION

There is frequently a requirement in active communication or detection systems to transmit beams of energy in more than one direction simultaneously from a single transducer. This requirement is most common in radar systems where beams of electromagnetic radiation are transmitted from an antenna. There is also a similar requirement in the sonar field where the energy is transmitted in the form of sound of a required frequency. For the most part the following description will be concerned with electromagnetic radiation.

In the radar field, multiple steerable beams are produced using a phased-array antenna comprising a number, usually a large number, of individual radiating elements. The phase and amplitude relationships between radiation produced by adjacent elements determines the direction of the beam or beams produced by the array. The relationship between the outputs of two adjacent elements is defined in the notation of a complex function known as the Aperture Weighting Function or AWF. The magnitude of the AWF squared is proportional to the RF power output of each element, averaged over several RF cycles, and the phase of the AWF gives the relative phase between the RF output from each element and the system's frequency reference source.

A highly-directive narrow beam can be formed when the phase of the AWF is a linear function of the array spatial coordinate. The position of such a beam in space is controlled by the gradient of this linear function. The shape of such a beam is primarily governed by the magnitude of the AWF. By tapering the AWF to small values towards the array extremities, it is possible to reduce the side-lobes of the beam.

For a single beam, an unweighted AWF could have the form:

$$W(x,\theta)=\exp(i*\theta*x)$$

where:

- $W(x,\theta)$ is the AWF exp represents the exponential function,
- x is the spatial or position coordinate of an element in the array,
- $\theta$ is a measure of the beam pointing angle,
- i signifies the square root of $-1$, and
- * represents the multiplication function.

If two beams are required simultaneously then the available power has to be divided between them. The radiation pattern is linearly related to the AWF by the Fourier transform, and so to produce a radiation pattern which is the sum of the two beams at angles $\theta$ and $\phi$ requires an AWF as follows:

$$\begin{aligned} W(x,\theta,\phi) &= [W(x,\theta) + W(x,\phi)]/\sqrt{2} \\ &= \sqrt{2}*\cos[(\theta-\phi)*x/2]*\exp[i*(\theta+\phi)*x/2]. \end{aligned}$$

A study of the above expression shows that elements having a value of x where $\cos[(\theta-\phi)*x/2]=0$ do not radiate any power, while those elements having a value of x where $\cos[(\theta-\phi)*x/2]=\pm 1$ always have to radiate twice the power which they did for a single beam. There is thus a risk that the array suffers from hot-spots at which elements are over-driven.

SUMMARY OF THE INVENTION

It is an object of the present invention to provide an energy transmission system in which multiple beams of energy may be radiated simultaneously in different directions without the risk of over-driving individual elements of the transducer array.

According to the present invention, there is provided a multiple-beam energy transmission system for the simultaneous radiation of at least two beams of energy directed in different directions from a single multiple-element transducer assembly, which system includes a single source arranged to generate a train of signal pulses, signal modifying means associated with each element and arranged to modify the phase and gain of each successive pulse of the signal and control means operable to control the operation of the signal modifying means such that the complex aperture weighting function applied to each successive pulse of the signal from the signal source results in the radiation of the required beams of energy from the transducer assembly.

According to a first embodiment of the invention, the signal modifying means comprises separate modifying circuits corresponding to each beam to be radiated and arranged to apply to each successive signal pulse a different phase shift relative to the phase of the signal source, the phase shift applied to any pulse signal by one modifying circuit being unrelated to that applied by each other modifying circuit, and summing means associated with each said element to combine the modified pulse signals applied to the said element.

According to a second embodiment of the invention, the signal modifying means comprise separate modifying circuits corresponding to each element of the transducer array arranged to modify the phase and gain of each successive pulse of the signal, and control means operable to control the operation of the signal modifying circuits such that the complex aperture weighting function applied to the signals from the signal source result in the emission of the required beams of energy from the transducer assembly.

The transducer assembly may radiate energy as electromagnetic radiation or in other forms capable of forming multiple simultaneous beams, such as pressure waves, using the appropriate form of transducer for transmission or reception of energy.

BRIEF DESCRIPTION OF THE DRAWINGS

The invention will now be described with reference to the accompanying drawings, in which:-

DETAILED DESCRIPTION OF THE PREFERRED EMBODIMENTS

Figure 1:
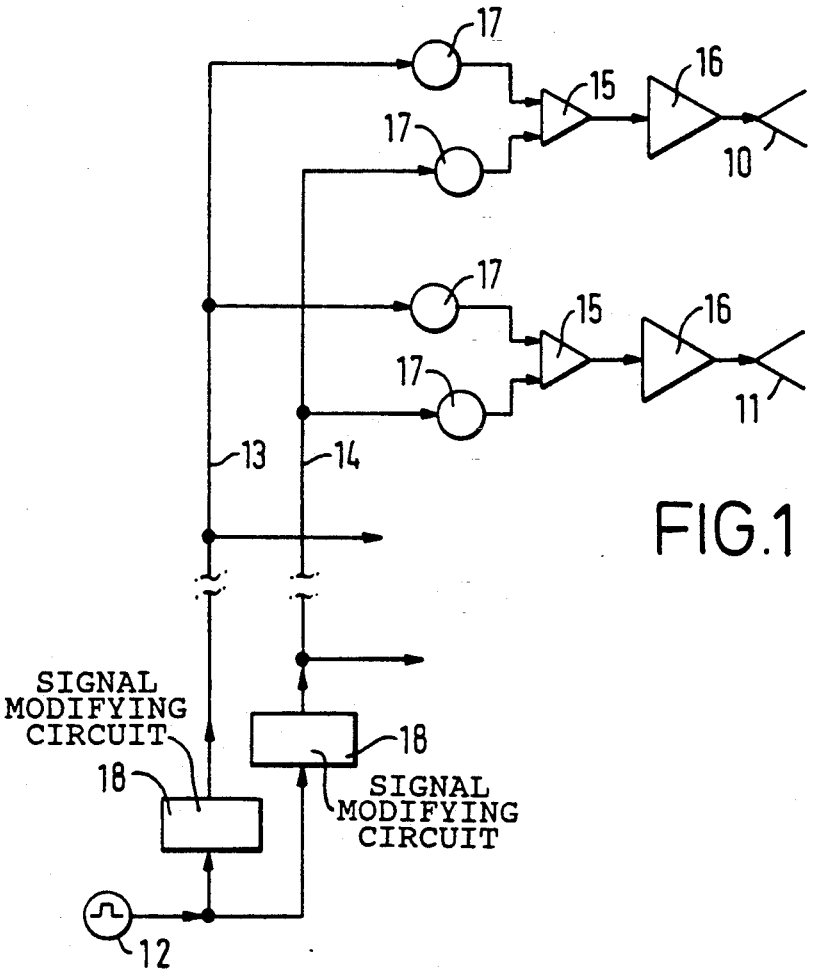
FIG. 1 is a schematic block diagram of a system according to a first embodiment of the invention.

Referring now to FIG. 1, this shows two elements 10 and 11 of a phase-array radar antenna. The entire array will consist of many more elements but all are connected in the manner to be described. Pulse signals for application to each element of the array are produced by a reference pulse source 12 and applied to each element by a signal feed. As shown in the drawing, two separate energy beams are to be transmitted by the antenna and hence two separate signal feeds 13 and 14 are shown between the reference source 12 and a summing amplifier 15 associated with each element. The output of the summing amplifier 15 is connected to a power amplifier 16 which supplies the power to be radiated to each element. As indicated schematically, each signal feed 13, 14 is similarly connected to each other element in the antenna. Each signal feed to each summing amplifier may include a phase shifter 17 provided for conventional beam-steering purposes.

Each signal feed 13, 14 also includes a pulse-modifying circuit 18 which applies a different phase shift to each successive pulse generated by the reference source 12. The phase shifts applied by one circuit 18 are different from those applied by the, or each, other such circuit relative to the reference source 12, and are not related to them by any mathematical expression.

The combination of signals for each element by the summing amplifiers 15 means that the antenna array produces two beams as before. However, the problem of hot-spots is substantially eliminated as is shown by a consideration of the AWF.

If a phase shift of $\alpha t$ is applied to signal feed 13 during the pulse occurring at time t, and a phase shift of $\beta t$ is applied to signal feed 14 at the same, time, the time-varying AWF's for the two beams may then be represents as follows:

$$W_1(x,\theta,t)=\exp(i*(\theta x+\alpha t))/\sqrt{2}$$

and $$W_2(x,\phi,t)=\exp(i*(\phi x+\beta t))/\sqrt{2}.$$

These are the functions applied to the pulse signals by the combination of the pre-distribution pulse-modifying circuits 18 and the post-distribution pulse-modifying circuits 17.

Combining these two expressions, the composite AWF of the two beams may be represented as:

$$W(x,\theta,\phi,t) = W_1(x,\theta,t) + W_2(x,\phi,t)$$

$$\sqrt{2}\ *\cos[(\theta - \phi)*x/2 + (\alpha t - \beta t)/2]$$

$$*\exp[i((\theta + \phi)*x/2 + (\alpha t - \beta t)/2)]$$

This expression represents the amplitude and phase of the signal. Consideration of the power radiated by an element leads to the expression being squared, to give an expression of the general form $2*\cos^2(\ )*\exp^2(\ )$. The amplitude of the $\exp^2(\ )$ term is 1, since the term contains the operator i, and the phase part of the term is irrelevant in a consideration of power. The amplitude term has a constant mean value, averaged over a period of time, of 1, regardless of the value of x. Hence the time-averaged power radiated by any element when producing two beams according to the invention is the same as that radiated to produce a single beam. Hence the problem of hot-spots is overcome.

The same reasoning may be applied for the formation of more than two beams of radiated energy.

Figure 2:
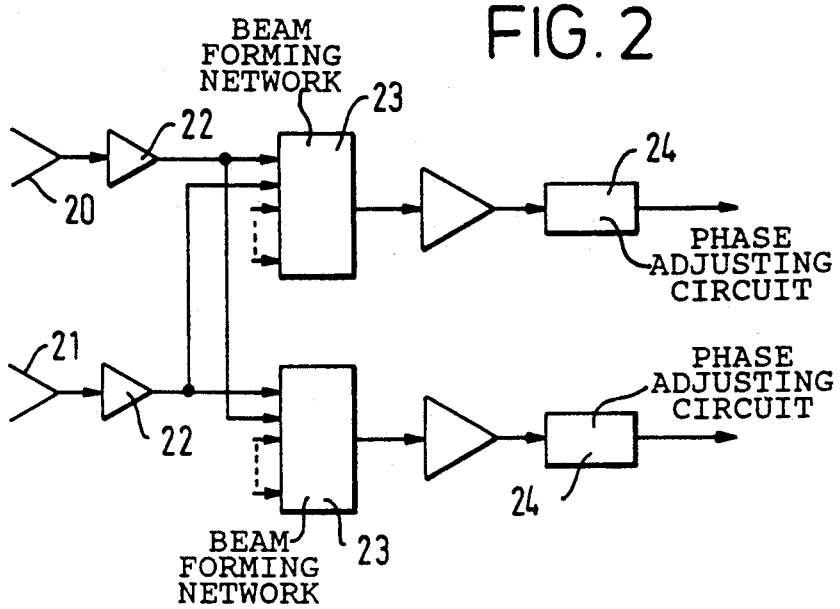
FIG. 2 is a schematic block diagram of a receiver arranged to operate with the system of FIG. 1.

It is probable in a radar installation that produces several transmitted beams that there will be separate receiver circuits responsive to energy reflected from each beam. Each receiver, therefore, requires an associated circuit which applies an opposite phase adjustment to each received pulse so as to restore the signal prior to the usual signal processing. FIG. 2 is a block schematic diagram of such an arrangement. Each of the large number of receiving elements, of which only two are shown at 20 and 21, supplies signals though an RF amplifier to each of a number of beam-forming networks 23. After further amplification, the signals from the beam-forming networks are applied to separate phase adjustment circuits 24 before passing to conventional processing circuits (not shown). The two phase adjustment circuits 24 apply to each successive received pulse the inverse phase shift to that applied by the corresponding pulse modifying circuit 18 of FIG. 1.

Figure 3:
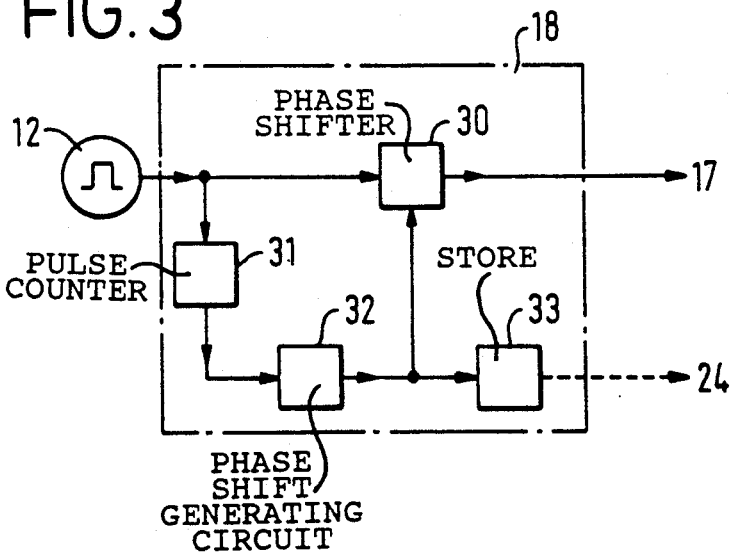
FIG. 3 is a block diagram of part of the system of FIG. 1.

One of the signal-modifying circuits 18 of FIG. 1 is shown in more detail in FIG. 3. The circuit 18 is supplied with pulse signals from the reference source 12 of FIG. 1 and these pass to a phase shifter 30. A pulse counter 31 counts the pulses and causes a phase-shift generating circuit 32 to generate a different value of phase-shift to be applied to each successive pulse. The phase-shift so identified is applied to the pulse by the phase-shifter 30. The value of phase-shift applied to each successive pulse is stored in a suitable store 33 for use by the receiver phase adjustment circuit 24 of FIG. 2.

Figure 4:
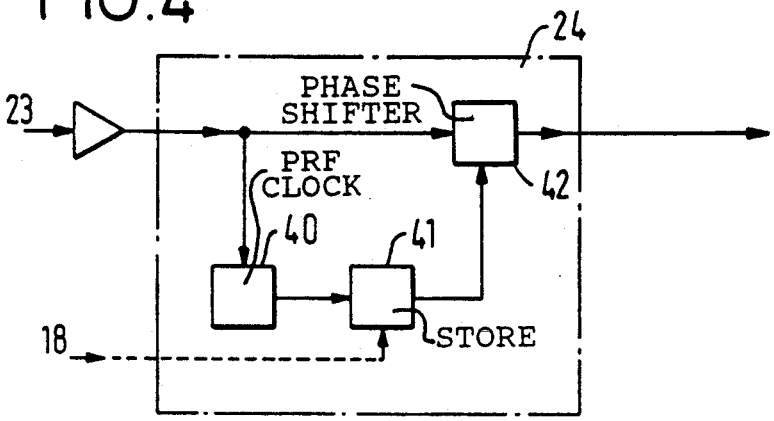
FIG. 4 is a block diagram of part of the receiver of FIG. 2.

FIG. 4 shows the corresponding phase adjustment circuit 24 of the receiver. It is preceded by the signal amplifier and also requires an input from, or knowledge of the contents of, store 33 of FIG. 3. It also requires a pulse counter or prf clock 40 which counts received pulses at the prf rate. As shown in FIG. 4, the circuit contains store 41 which holds the inverse phase-shift values to those stored in store 33. The appropriate values are applied to phase-shifter 42.

It is likely that not all transmitted pulses result in a received signal and hence the prf clock 40 is necessary to ensure that received pulses are correctly identified.

The circuit elements shown in FIGS. 1 to 4, apart from the RF amplifiers 16 of FIG. 1, may be digital or analog circuit elements. Digital circuitry may readily be used and, in such a case, the phase shifters 30 and 42 would comprise standard circuits for multiplication and addition connected together so as to perform the necessary complex multiplication function. The phase selection and storage elements may be in hardware form or in the form of software for a microcomputer.

As will be seen from FIG. 1, each element of the array requires not only an associated summing amplifier 15, but also a separate phase-shifter 17 for beam steering purposes, for each beam to be radiated. This leads to a large circuit requirement and also means that the number of beams to be radiated cannot exceed that for which the system was built. On the other hand, only one signal modifying circuit per radiated beam is required.

Figure 5:
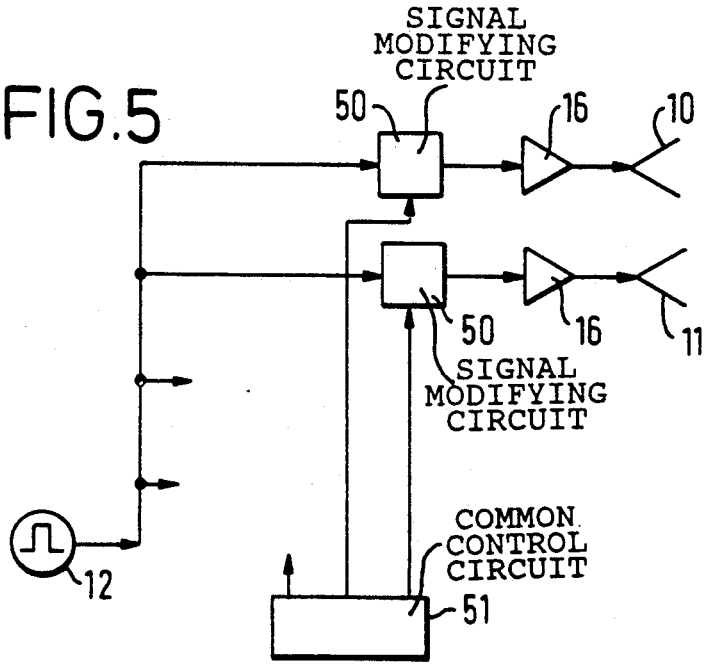
FIG. 5 is a schematic block diagram of a system according to a second embodiment of the invention.

An alternative arrangement, which leads to circuit simplification in some areas, is shown in FIG. 5. This shows a single signal feed from the reference pulse source 12 to the RF amplifier 16 associated with each element of the array. However, before each RF amplifier 16 is a separate signal-modifying circuit 50. There is, therefore, one of these circuits 50 for each separate element of the array. The operation of each signal modifying circuit is controlled by a common control circuit 51. Each circuit 50 is controlled so as to generate the required composite AWF for each element of the array, and will need to change both the amplitude and the phase of the signal pulse for each successive pulse.

Since the overall transmitted signal is the same as in the case of the first embodiment, the receiver arrangement of FIG. 2 is still used with the transmitter arrangement of FIG. 5.

In either embodiment, the special case which exists when the phase function for each beam forms a uniform progression in time from pulse to pulse may be considered as applying a synthetic Doppler shift to the pulse train for that beam. In such a case, where the receiver uses Fourier analysis of the received signals to form Doppler filters, it is sufficient to re-interpret the calibration of the Doppler filters to allow for the added synthetic Doppler shift on transmission, so that the phase adjustment circuit 24 of FIG. 2 is not then required.

It is not always necessary to store and recall the applied phase shifts for the receiver arrangement. If, for example, the applied phase shifts are determined by a repeated algorithm, then it is only necessary to recalculate the applied phase shifts rather than to store the actual values as described above.

As explained above, a pulse count is necessary to prevent ambiguity arising due to return pulses being compensated by the wrong phase shift. In fact, if this does happen and the phases form a uniform progression in time as considered above, then the same error is made for every pulse for each beam. Coherent signal processing will work properly apart from the determination of the absolute phase of the return signal. This value is not often required, in which case a pulse ambiguity can be tolerated.

If the pulse repetition rate is sufficiently low so that a return pulse will be received before the next pulse is transmitted, then the phase shift with time may be completely random. This results in the generation of a more complex waveform, with advantages against jamming or other forms of electronic warfare. The pulse counter is no longer required in such a situation.

The descriptions given above have all been concerned with radar systems, that is systems where the energy is transmitted and received as microwave electromagnetic energy. As stated earlier, similar techniques may be used with electromagnetic energy transmitted at other wavelengths, for detection or communication systems. Similarly the techniques are applicable in the field of pressure waves such as sound waves. Different forms of energy and different wavelengths of electromagnetic energy require different but well-known forms of transducer for the radiation and reception of that energy.

I claim:

1. A multiple-beam energy transmission system for the simultaneous transmission of at least two beams of energy directed in different directions from a single multi-element transducer assembly, which system comprises:

a signal source arranged to generate a train of successive signal pulses;

signal modifying means associated with each element for modifying the phase of each successive signal pulse by applying to each successive signal pulse a complex aperture weighting function, different phase shifts being applied to successive signal pulses, the phase shifts applied for one beam being unrelated to those applied for another; and control means for controlling operation of the signal modifying means such that the complex aperture weighting function applied to each successive signal pulse from the signal source by the signal modifying means results in the radiation of the required beams of energy from the multi-element transducer assembly.

2. A transmission system as claimed in claim 1 in which the signal modifying means comprises:

separate modifying circuits corresponding to each beam to be radiated and arranged to apply to each successive signal pulse a different phase shift relative to the phase of the signal source, the phase shift applied to any pulse source by one modifying circuit being unrelated to that applied by each other modifying circuit; and summing means associated with each element for combining the modified pulse signals applied to the respective element.

3. A transmission system as claimed in claim 1 in which the signal modifying means comprise separate modifying circuits corresponding to each element of the transducer array arranged to modify the phase and gain of each successive signal pulse.

4. A transmission system as claimed in claim 2 in which each modifying circuit includes:

a phase-shift generating circuit for generating the phase shift to be applied to each successive pulse from the pulse source;

phase-shifting means for applying the appropriate phase shift to each said pulse; and store means for storing a phase shift value for the phase shift generated by said phase-shift generating circuit and applied to each said pulse by said phase-shifting means.

5. A transmission system as claimed in claim 4 which includes a pulse counter for counting the pulses generated by the pulse source, the store means being arranged to store the identity of each pulse together with the value of the phase shift applied thereto.

6. A receiver for use with a transmission system as claimed in claim 1 which includes a separate phase-adjustment circuit corresponding to each beam and operable to apply to receive signals an inverse phase shift to that applied by the signal modifying means of the transmission system.

7. A transmission system as claimed in claim 1 in which the beams of energy are radiated in the form of electromagnetic energy.

8. A multiple-beam energy transmission system for the simultaneous transmission of at least two beams of energy directed in different directions from a single multi-element transducer assembly, the system comprising:

a signal source means for generating a train of successive signal pulses;

signal modifying means associated with each element, for modifying the phase of each successive signal pulse by applying to each successive signal pulse a complex aperture weighting function, different phase shifts being applied to successive signal pulses, the phase shifts applied for one beam being unrelated to those applied for another;

control means for controlling operation of the signal modifying means wherein the complex aperture weighting function applied to each successive signal pulse from the signal source means by the signal modifying means results in the radiation of the at least two beams of energy from the multi-element transducer assembly; and a separate phase-adjustment circuit for each beam operable to apply to received signals an inverse phase shift to that applied by the signal modifying means.

* * * * *